United States Patent [19]

Wilson et al.

[11] 4,054,096

[45] Oct. 18, 1977

[54] MOBILE ELEVATIONALLY ADJUSTABLE STAGE

[75] Inventors: Kermit H. Wilson, Edina; Ronald R. Carlson, Mound; Richard C. Bue, Chaska, all of Minn.

[73] Assignee: Sico Incorporated, Minneapolis, Minn.

[21] Appl. No.: 674,168

[22] Filed: Apr. 6, 1976

[51] Int. Cl.[2] ..... A47B 3/00

[52] U.S. Cl. ..... 108/113

[58] Field of Search ..... 108/18, 19, 112, 113, 108/160

[56] References Cited

U.S. PATENT DOCUMENTS

| | | | |
|---|---|---|---|
| 2,747,958 | 5/1956 | Wilson | 108/113 |
| 2,766,089 | 10/1956 | Nielson | 108/113 |
| 2,993,740 | 7/1961 | Good | 108/19 X |
| 3,143,982 | 8/1964 | Blink et al. | 108/113 |
| 3,557,720 | 1/1971 | Blink et al. | 108/113 |
| 3,799,073 | 3/1974 | Nielson | 108/113 |
| 3,861,325 | 1/1975 | Bue et al. | 108/113 X |

*Primary Examiner*—James C. Mitchell

*Attorney, Agent, or Firm*—Merchant, Gould, Smith, Edell, Welter & Schmidt

[57] ABSTRACT

The stage section comprises a pair of planar stage surface members hinged together for movement between a compact folded position, and an operative position. Pairs of main support legs are pivotally attached to each stage surface member so as to remain substantially vertical to support the stage in both the operative and folded positions. Castor wheel assemblies are mounted near the bottoms of the support legs, and a manually actuated mechanism is provided for controlling the retraction or extension of the wheels into ground engaging position, independently of the unfolding of the stage, so that the stage can first be unfolded, then moved precisely into the desired position before retracting the wheels to transfer the stage load to the support legs. A safety locking mechanism for stabilizing the stage in its unfolded, operative position has a lever which projects alongside the edge of the stage in its unlocked position, so as to prevent inadvertently juxtaposing a plurality of stage sections to form a large stage surface, while the sections are in their unlocked position. Telescoping support legs, and adjustable cross braces cooperate to provide great stability of the structure even at very high positions of the stage.

12 Claims, 12 Drawing Figures

FIG.4
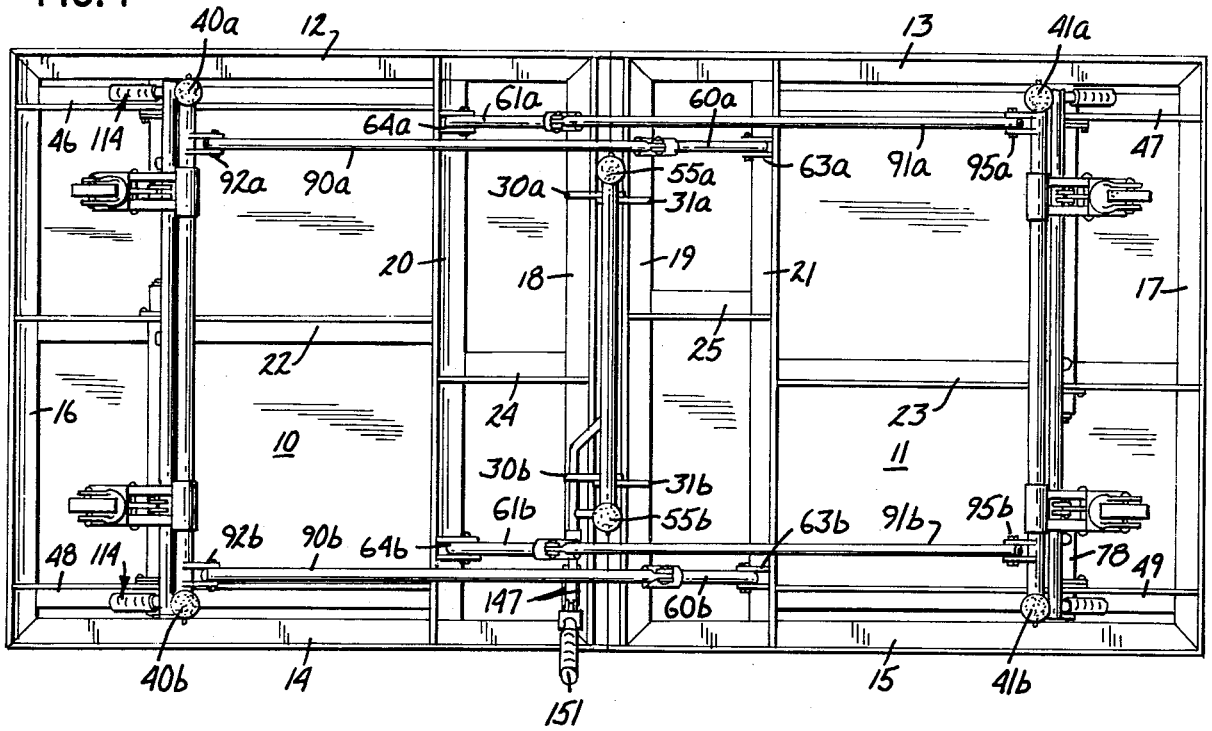
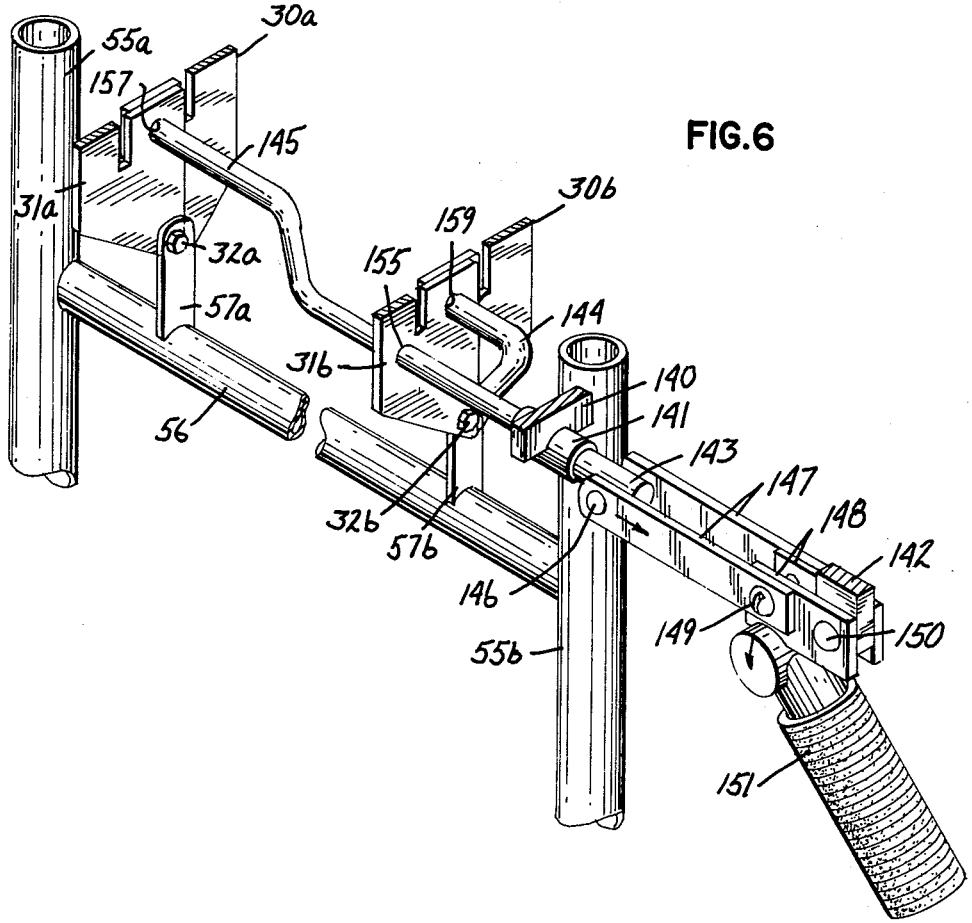
FIG.6

FIG.11
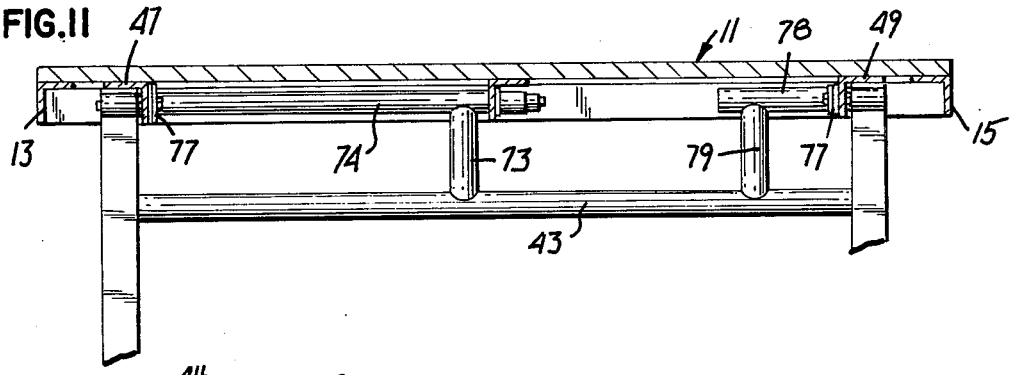
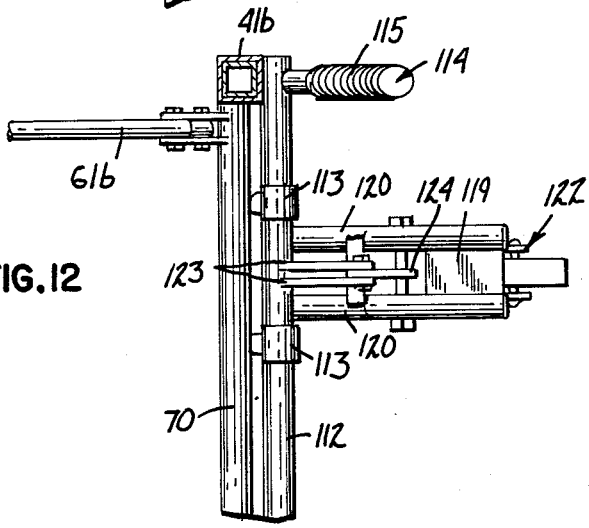
FIG.12
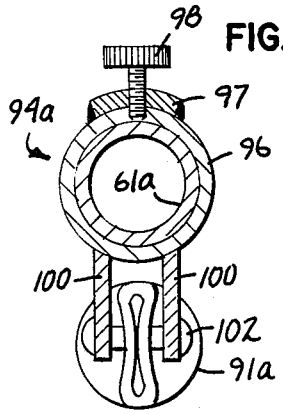
FIG.8
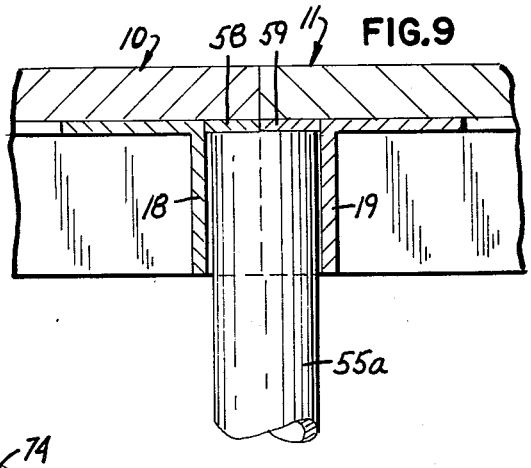
FIG.9
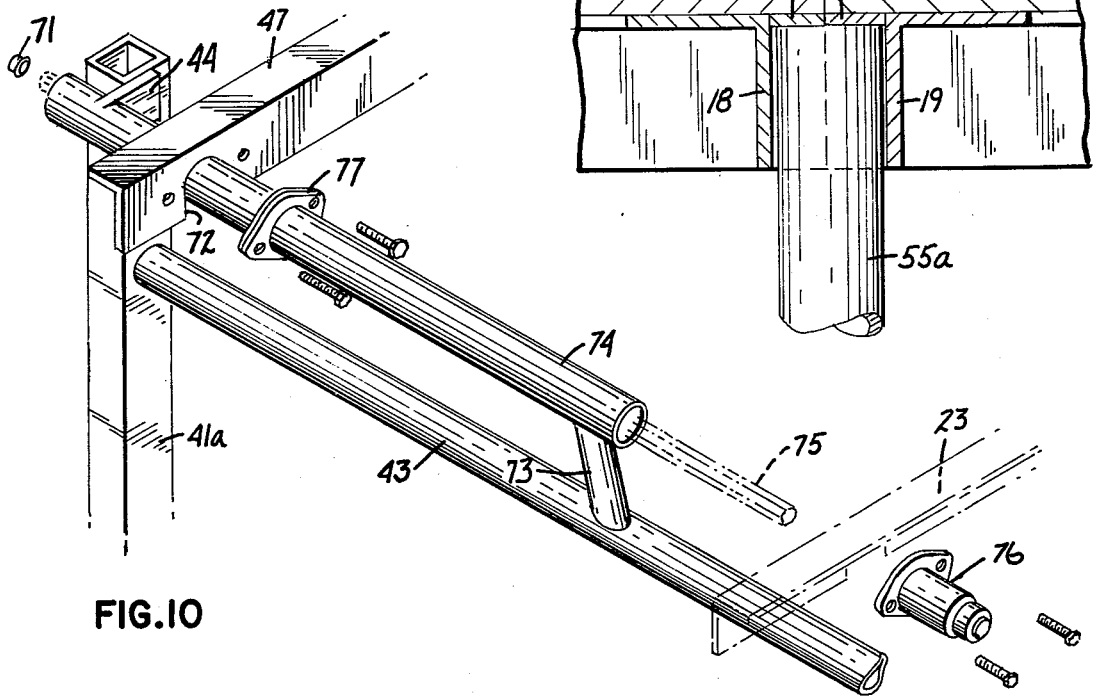
FIG.10

MOBILE ELEVATIONALLY ADJUSTABLE STAGE

BACKGROUND OF THE INVENTION

The present invention pertains to the field of mobile elevationally adjustable folding stages, and to improvements therein. Stages generally of this type having come into wide-spread use in schools, hotels, convention centers, and other institutions wherein multiple use facilities require the capability of setting up a temporary stage. Such stages are made up of a number of individual sections which are positioned adjacent each other to make an extended stage surface of whatever size is required. When not in use, the individual sections may be folded to compact dimensions, then set aside for storage. Most such stages are made up of at least two stage surface members hinged together to allow the folding action, and have legs which are also pivoted to either fold out of the way or to remain in floor contact position while the stage surfaces fold to the stage position. Often wheels are provided to make the stage section mobile, so that it can be more easily transported from the use area to a storage area.

Elevationally adjustable folding stages have recently been developed to further increase the utility of the folding stage concept. Examples of such developments are found in copending United States patent application Ser. No. 626,979, invented by Kermit H. Wilson, Richard C. Bue and Ronald R. Carlson, now Patent 4,026,221 and Ser. No. 638,167, invented by Kermit H. Wilson, now Patent 3,999,491. Although the stages developed to date have been very successful in achieving their object of providing efficient and useful stages, further improvements are of course still possible, particularly with regard to stages having a very high maximum height, and also in regard to improving the convenience and efficiency in setting up the stage for use.

With regard to the maximum height of the stage, some designs which perform very well in small stages, or ones with a limited range of elevational adjustment, do not readily lend themselves to larger or higher stages, in part because of the need for increased rigidity to prevent swaying or shaking in a tall stage section. Of course all parts can be proportionately strengthened, but the resulting structure is not necessarily the most efficient in terms of weight, cost and difficulty of handling. The present invention provides a stage which is especially advantageous in stages of great height and load carrying capability, although it is equally well adapted for smaller stages.

The wheels in mobile folding stages are provided as a convenience in moving the stage to and from the storage area, but some means must be provided to insure that the stage is not free to move while being used in its operative position. Locking type arrangements on castor wheels are generally unsatisfactory for stages which must hold any appreciable amount of weight, or for active loads, such as persons, rather than mere static loads. For this reason retraction mechanisms have been developed whereby the wheels extend slightly lower than the leg when the stage is folded up, but are retracted to slightly shorter than the legs when the stage is in use, so that the full weight of the load is borne on the legs rather than the wheels. In prior art stages, wheel retraction has been tied to the unfolding of the stage, either by a special linkage connected from the folding stage mechanism to the wheels, or by means of the geometry of the leg/wheel assembly which changes during unfolding to pivot the wheel out of ground contact. Since either method relies on the unfolding of the stage for retracting the wheels, the disadvantage arises in that it is impossible to exactly position the stage while it is still on its wheels.

For example, if a number of stage sections are being juxtaposed to form a large stage, it is necessary that each stage surface abut the adjacent one, so that no gaps are left. The folded prior art stage may be wheeled into approximate position, but final adjustment of the position will be necessary after it is fully unfolded since it is impossible to guess the exact location while the stage is still folded. But at the time the adjustment in position is necessary, the wheels have already been retracted, requiring one or two workers to lift and reposition the stage.

The present invention provides a manually actuated retraction/extension mechanism for the wheels which is independent of the folding or unfolding of the stage. Thus, the stage may be unfolded to operating position, then easily wheeled exactly into position before retracting the wheels to transfer weight to the legs. When setting up a large number of stage sections, the resulting increased efficiency can result in a substantial savings of time and effort.

The present invention further improves over prior art stages by permitting the stage to be folded for storage without first having to lower the stage to its lowest position. With some prior art stages, it was necessary to first lower the stage at least from its highest position before it could be folded for storage. This presents additional unnecessary handling time for a user who usually needs the stages set up in an extended position.

The present invention, by providing center support legs, by maintaining the main support legs substantially vertical when unfolded, and by providing adjustable cross braces, achieves a great height extension capability and load bearing capability from a lighter, stronger and more efficient structure.

Locking means for securing the stage in its unfolded, operative position are also provided in the present invention. In the preferred embodiment, the locking means operates in conjunction with the hinged connection between the stage surface members. The locking means performs the primary function of preventing the stage from starting to fold when loads are placed on the ends of the stage surfaces. The lock also performs a secondary function in permitting the unfolded stage to be lifted and supported by a fork lift while the legs are being elevationally adjusted.

In the preferred embodiment, the actuating lever for the locking means is positioned at the side of the stage so that it projects upwards alongside the edge of the stage when in its unlocked position. This prevents an unlocked stage section from being inadvertently moved in position immediately adjacent another to form a large stage surface. The upward projecting locking lever thus serves as a reminder that the stage must be locked before use.

SUMMARY OF THE INVENTION

According to the present invention, there is provided a mobile foldable stage comprising a pair of stage surface members which are hinged together for movement between a compact folded position and an operative unfolded position. Main support legs pivotally attached to each stage surface member cooperate with cross connect links so that the main support legs are maintained in a substantially vertical position in both the folded and unfolded positions. Retractable wheels are provided for extending beyond the main support legs in their extended position, and for retracting to a position short of the main support legs in their retracted position. Means are provided for controlling the retraction or extension of the wheels independently of the folding or unfolding of the stage.

Center support legs associated with the hinge means support the center of the stage.

In a preferred embodiment, the main and center legs are telescoping, to provide elevational adjustment of the stage. Adjustable cross braces connecting from the main support legs to the cross connect links add to the rigidity of the stage with its legs in the extended position.

Lock means are provided in connection with the hinged connection between the stage surface members, for rigidly locking the stage in its unfolded, operative position. An actuating lever for the locking means is provided and is positioned for extending along the side of the stage when unlocked, so as to prevent placing an unlocked stage section adjacent another.

BRIEF DESCRIPTION OF THE DRAWINGS

FIG. 4 is a view in bottom plan of the stage of FIG. 1 in its operative position;

FIG. 6 is a fragmentary detail in perspective of the center leg and locking means of the stage of FIG. 1;

FIG. 8 is a detail sectional view taken generally along the line 8—8 of FIG. 1;

FIG. 9 is an enlarged fragmentary detail of the center leg and stage surface members of the stage of FIG. 1;

FIG. 10 is an exploded perspective of the counter balance torsion assembly of the stage of FIG. 1;

FIG. 11 is an enlarged sectional view taken generally along line 11—11 of FIG. 1; and FIG. 12 is a top plan of the wheel and retraction/extension means shown in detail in FIG. 5.

DETAILED DESCRIPTION OF THE PREFERRED EMBODIMENT

Figure 1:
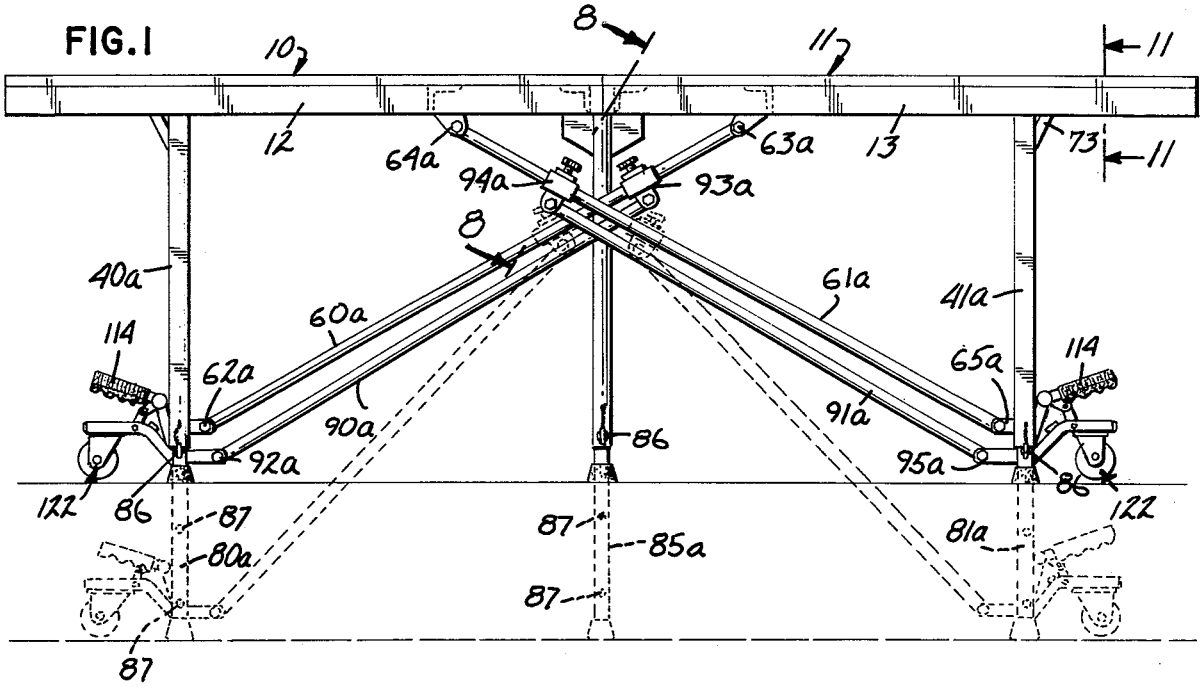
FIG. 1 is a view in side elevation of a stage according to the present invention, with an elevationally extended position shown in dotted line.
Figure 3:
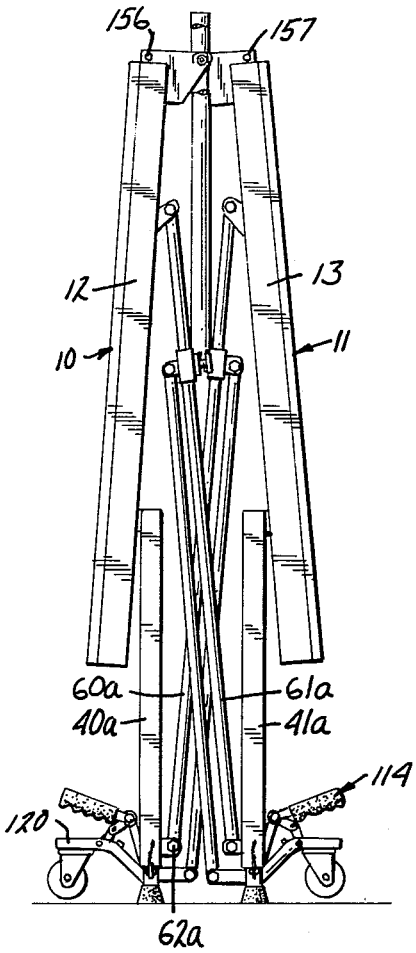
FIG. 3 is a view in side elevation of the stage in folded position of FIG. 2.
Figure 2:
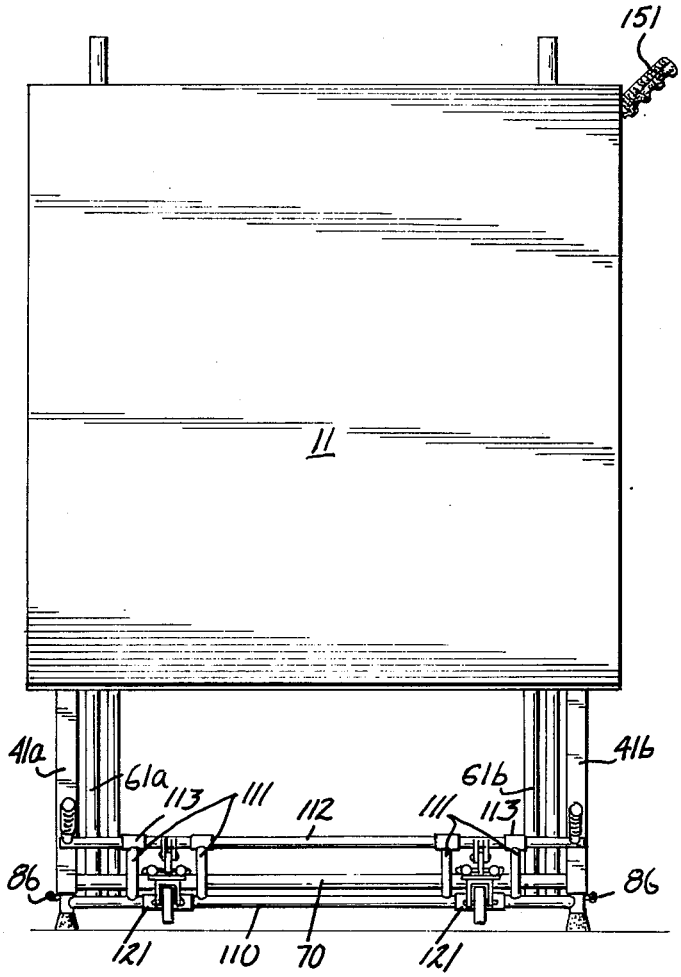
FIG. 2 is a view in end elevation of the stage of FIG. 1, in its folded position.

The overall configuration of the stage according to the present invention is best seen in FIGS. 1 and 4, which show the stage in its unfolded or operative position, and FIGS. 2 and 3 which show the stage in its folded or storage position. The stage comprises a pair of stage surface members 10 and 11. Each stage surface member is a generally rectangular planar member which may be made of any suitable material. For example, in the preferred embodiment, stage members 10 and 11 are made of particle board with a suitable bonded wear-resistant top surface. Each of the stage surface members is reinforced underneath by a reinforcing frame made up of a number of pieces of welded angle iron rails. As seen in FIG. 4, member 10 has side reinforcing rails 12 and 14, while member 11 similarly has side rail 13 and 15. Member 10 has end rails 16 and 18, while member 11 has corresponding end rails 17 and 19. Each stage surface member has an intermediately positioned transverse reinforcing rail 20 and 21 respectively, and intermediately spaced longitudinally extending reinforcing rails 22 and 23, respectively. An additional rail 24 extends from rail 20 to rail 18, and a corresponding rail 25 on the other stage member extends between rails 19 and 21.

The reinforcing rails described above are welded together to form a rigid supporting frame for each stage surface member, which may then be bolted or otherwise attached to its respective base frame. The reinforcing base frame also serves as convenient attachment points for the legs, hinges and other hardware items as hereinafter described.

Stage surface members 10 and 11 are hingeably connected to each other along one edge of means of a pair of hinge assemblies. A pair of hinge plates **30*a* and 30*b* are welded to reinforcing rail 18, and a pair of similar hinge plates 31*a* and 31*b* are welded to reinforcing rail 19 of stage surface member 11. The corresponding hinge plates 30 and 31 are spaced opposite each other but offset slightly so as to overlap. The hinge plates are pivotally connected by means of pivot bolts 32*a* and *b*, as seen also in FIGS. 6 and 7. The hinges thus described permit relative movement of the stage surface members 10 and 11 between a compact folded or storage position as indicated in FIG. 3, in which the stage surface members are generally vertically oriented, and an unfolded or operative horizontal position as indicated in FIG. 1** in which the stage surface members are horizontal and define a continuous stage surface.

Each of the stage surface members has a pair of main support legs. For stage surface member 10, the main support legs comprise a leg **40*a* as seen in FIG. 1, and a corresponding leg 40*b* on the other side not visible in FIG. 1, but shown in FIG. 4. Similarly, member 11 has main support legs 41*a* and b. The main support legs may be made for convenience from square metal tubing, as is more clearly seen for example in FIG. 10. Each of the pairs of main support legs 40*a*, *b*, and 41*a*, *b* are interconnected by a cross brace, such as brace 70 in FIG. 2, at the lower portion of the main legs. An upper cross brace, such as brace 43 of FIG. 11** is also provided between the legs of each pair of main support legs.

Each of the main support legs is pivotally connected to reinforcing rails underneath their respective stage surface members, as more fully explained hereinafter with respect to FIG. 10. Referring specifically to FIG. 4, additional reinforcing rails 46 and 48 are positioned adjacent rails 12 and 14, respectively, beneath member 10. Similarly, reinforcing rails 47 and 49 are positioned adjacent rails 13 and 15, respectively, beneath member 11. The flat portion of reinforcing rail 46 provides a bearing surface for transmitting the weight of the stage onto the top of main support leg **40*a* rather than applying it through the leg pivot bolt. Alternatively, if it is desired that rails 12 and 46** are spaced further apart, a separate plate can be welded therebetween for abutment by the top of the leg. A construction similar to that just described exists with respect to each of the other three main support legs.

In addition to the main support legs, the stage has a pair of center legs **55*a*, and 55*b*, as seen in FIG. 4. Center legs 55*a* and 55*b* may be of tubular construction, and are linked by a horizontal cross brace 56, as also seen in FIG. 6. Welded to and extending upward from cross brace 56 are hinge tabs 57a and 57b, which are spaced to correspond to the spacing of hinge plates 30a, 31a, and 30b, 31b. The hinge plates 30–31 and the tabs 57 are all pivotally attached by means of the pivot bolts 32a** and *b*, so that the entire center leg assembly is attached to the same hinge means which interconnect stage surface members 10 and 11. When the stage is folded up, as indicated in FIG. 3, the center legs are lifted up with the hinge means. When the stage is in its operative position, as shown in FIG. 1, the top of the center legs serve to support the center of the stage, not through the pivot bolts 32, but rather through direct abutment from the stage surface members on the top of the center legs. This is shown in greater detail in FIG. 9. Additional flat iron pieces 58 and 59 are attached beneath stage surface members 10 and 11, respectively, along the adjacent edges thereof, to provide a surface to bear upon the tops of the center legs.

Referring again to FIGS. 1 and 4, a plurality of cross connect links are seen interconnecting the stage surface members to the main support legs of the opposite stage surface member. Cross connect links 60a and 60b are connected by pivots to the lower portions of main support legs 40a and 40b; link 60a is connected by pivot 62a, and link 60b is connected by a similar pivot (not shown). The upper ends of links 60a and 60b are attached by means of pivots 63a and 63b to the underside of stage surface member 11. Pivots 63 may be made from tabs welded to a reinforcing angle iron, with a pivot bolt capturing the end of the cross connect link. Similarly, the upper ends of cross connect links 61a and 61b connect by means of pivots 64a and 64b to the underside of stage surface member 10. The lower ends of links 61a and 61b connect by means of pivots 65a and 65b to the horizontal brace 70 which interconnects the lower ends of main support legs 41a and 41b. In similar fashion, the lower ends of cross connect links 60a and 60b connect by means of pivots (62a for link 60a, jand a similar pivot, not shown, for link 60b) to the cross brace which interconnects the bottoms of main support legs 40a and 40b which is not visible in the views, but which corresponds to brace 70 at the other end of the stage.

The lengths of cross connect links 60 and 61, together with the mounting points for the respective pivots are selected to achieve a geometry which results in maintaining legs 40 and 41 substantially vertical, as the stage is moved to its folded position as indicated in FIG. 3. Thus, in addition to providing strength and rigidity for the structure, the cross connect links are part of the folding and unfolding mechanism.

To assist in folding and unfolding the stage, counterbalance bias springs are provided, as shown most clearly in FIGS. 10 and 11, also visible in FIG. 4. In the preferred embodiment, torsion bars are used, although any type of counterbalance bias spring may be used if desired. In FIG. 10, a detail of main support leg 41a and cross brace 43 are shown, but it will be appreciated that an identical structure would apply with respect to main support leg 40b, since a torsion bar bias is used on each half of the stage Welded to brace 43, which extends between legs 41a and 41b, is a strut 73. A tubular sleeve 74 is welded to strut 73, and is aligned parallel to brace 43 to define the pivot axis of the legs. A torsion bar 75 is positioned coaxially within sleeve 74, and a torsion bar clamp assembly 76 secures the end of torsion bar 75 to intermediate reinforcing rail 23. The other end of torsion bar 75 is attached rigidly to the inside of sleeve 74 by a retainer cap 71. A notch 72 is provided in the flange portion of reinforcing rail 47 to provide clearance for sleeve 74. Sleeve 74 is held in position by means of retainer flange 77 which may be made of a single thick piece of metal, or from a plurality of thinner pieces as indicated in the drawing. Retainer flange 77 is bolted to rail 47 to locate sleeve 74 in notch 72, but sleeve 74 is free to rotate therein, for folding of the legs.

The top of main support leg 41a is offset from sleeve 74, but rigidly secured thereto by means of a tab 44 which is welded to both the leg and the sleeve. As seen in FIG. 11, sleeve 74 does not extend the full width of the stage. However, for purposes of pivoting of the legs, a pivot tube 78 is provided in conjunction with leg 41b, to perform the same location and pivot axis definition function that sleeve 74 performs with respect to leg 41a. Pivot tube 78 is axially aligned with sleeve 74, and is connected to cross brace 43 by means of a strut 79, similar to strut 73. Pivot tube passes through a notch in the flange of rail 49, similar to notch 72 of rail 47, and is secured in place but is free for rotary motion, by means of another retainer flange 77. The top end of leg 41b is secured to the other end of pivot tube 78, by means of a tab welded thereto, not visible in FIG. 11, but similar to the connection of leg 41a to sleeve 74 by means of tab 44 of FIG. 10.

In operation, as the legs fold or unfold, the rotary motion is transmitted via brace 43 and strut 73, which acts as a lever arm, to twist sleeve 74. Sleeve 74 applies the torsion to bar 75, whose other end is secured to reinforcing rail 23 which runs along the center line of the table. Thus, the counterbalancing force is applied between the center of the stage member, along rail 23, to the center of the main support leg pair 41a, *b*, by strut 73, because the force from torsion bar 75 is essentially folded back to the middle by means of concentric sleeve 74. Maintaining the counterbalance bias force in the center of the leg pair prevents undesirable asymmetrical forces which would otherwise be encountered if the counterbalance spring only applied force to one leg. The counterbalance force provided by torsion bar 75 thus assists in lifting the weight of the stage as it is folded upward to its folded position as shown in FIG. 3, so that less manual effort is required to fold the stage. By the same token, the counterbalance torsion bar helps to offset the weight of the stage so that it does not fall down and out abruptly during unfolding of the stage.

The stage according to the present invention is elevationally adjustable, and for this purpose the main support legs and center legs all have telescoping outer sections to achieve the height adjustment. Center legs 55a and *b* have telescoping outer portions including 85a on one side of the stage as indicated in broken lines in FIG. 1, and a corresponding portion on the other side, not shown. Main support legs 40a and *b* have telescoping ouer portions 80a and *b*, respectively, and legs 41a and *b* have similar telescoping outer portions 81a and *b*. All of the telescoping outer portions of the legs may be tubular of slightly smaller dimensions than the upper portion of the same leg, so that they may be shoved up within the main legs when not in use. They may be extended downwardly to the desired height, and held in place by means of pins 86 provided on each leg, and adjustment holes 87 provided at spaced intervals along the telescoping outer portions of the legs. Rubber feet 88 may be provided on all legs.

Adjustable stabilizing braces are provided for each of the cross connect links 60, 61. Each of the cross connect links 60*a,* 60*b,* 61*a* and 61*b* has an adjustable stabilizing brace associated with it. In FIG. 1, stabilizing brace 90*a* is associated with cross connect link 60*a.* Brace 90a has a lower end attached by means of a pivot 92*a* to tabs near the bottom of telescoping outer leg 80*a.* The upper end of brace 90a is pivotally connected to a locking collar 93*a.* In like manner, stabilizing brace 91*a* is pivotally connected at 95*a* to telescoping outer portion 81*a,* and to a sliding locking collar 94*a* on link 61*a.* Corresponding stabilizing braces with pivotal connections and locking collars are found on the opposite side of the stage also, having like reference numerals with *b* suffixes.

The locking collar is shown more clearly in cross section in FIG. 8, which is a section through locking collar 94*a.* However, it will be appreciated that the construction details shown in FIG. 8 are equally applicable to all four locking collars on the stabilizing braces. In FIG. 8, a section of link 61a is shown, having a coaxially tubular member 96 disposed therearound. A small reinforcing thickness 97 is welded to the top of tubular piece 96, and a set screw 98 is threaded through a hole in elements 96 and 97 to contact the edge of link 61*a.* A pair of tabs 100 on the opposite side of the collar serve to attach the collar to the end of brace 91a, by means of a rivet or bolt 102 which passes through the flattened end of the otherwise tubular member which comprises brace 91*a.*

When the telescoping outer portions of the legs are to be extended, this requires a change in the geometry of the stabilizing braces. With the set screws 98 of the collars in a loosened condition, the collars will slide downwardly along the cross connect links as required. Once the locking pins 86 have been inserted to establish the desired height of the stage, said screws 98 on the locking collars are tightened. This serves to increase the rigidity of the stage in its elevated position, by virtue of the triangular brace which is in effect formed between the extended outer portions of the legs the cross connect links, and the stabilizing braces.

An important feature of the present invention is the provision of retractable wheel means which are operable independently of the folding or unfolding of the stage. The details of the wheel means are seen most clearly in FIGS. 5 and 12, and the connection of the wheel means to the stage is also seen in FIGS. 1–4.

As seen in FIG. 2, the cross brace 110 interconnects the telescoping lower portions of the main support legs. Welded to brace 110 are four upright struts 111, which project upwardly and slightly outwardly therefrom, as better seen in FIG. 5. The outward tilt of struts 111 is necessary to clear the thickness of the main support legs, for example leg 41a in FIG. 5. Although the following description focuses primarily on individual wheel assemblies, it will be appreciated that the same description is equally applicable to all of them. A pivot bar 112 extending substantially the width of the stage is pivotally mounted in sleeves 113 attached to the tops of uprights 111. An actuating lever 114 is attached to pivot bar 112 at either end thereof. For convenience, actuating levers 114 can be covered with a suitable rubber sleeve as at 115, for easier hand or foot actuation.

A pair of angled wheel mounting brackets 120 are welded to a sleeve 121 which is positioned for pivotal movement about brace 110. Near their other ends brackets 120 are interconnected by a plate 119. A castor wheel assembly 122 is connected by any suitable means to the bottom of plate 119. A pair of tabs 123 are welded to pivot bar 112, and a link 124 is pivotally connected to both tabs 123, at pivot 125, and both wheel mounting brackets 120, at pivot 126. A bar 127 is welded to wheel mounting brackets 120 at the bends therein.

Figure 5:
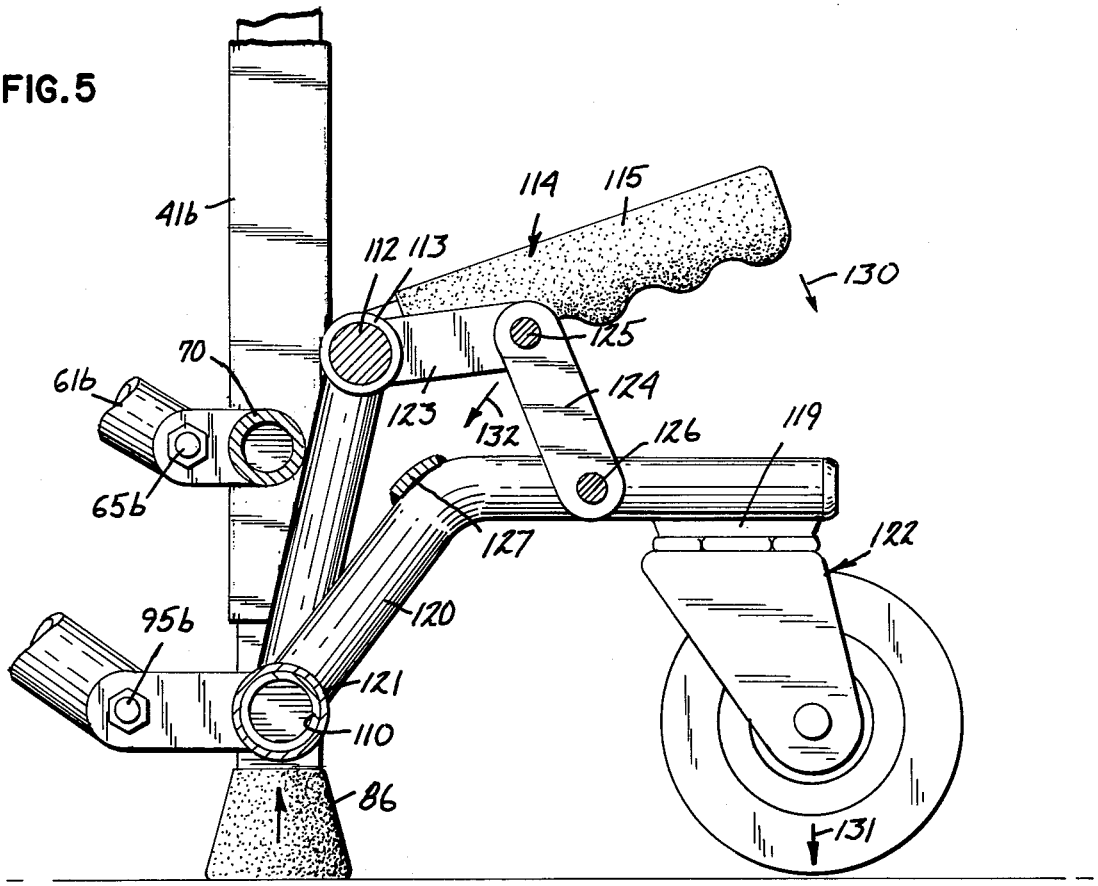
FIG. 5 is an enlarged fragmentary detail of the wheel and wheel retraction/extension mechanism for the stage of FIG. 1.

FIG. 5 shows the wheel means in its retracted position with the full weight of the stage resting on the leg assemblies. To extend the wheels, actuating lever 114 is pushed downward as indicated by arrow 130. This can be done at either side of the stage, since the pivot bar extends the full width, and a handle is provided at either end. Movement of the actuating lever can be done by hand, or simply by pushing downward with the foot. Downward motion of the actuating lever causes the same pivoting motion of tabs 123, since they are attached to the same pivot bar. This brings tabs 123 and link 124 more into line, thereby forcing pivot 126 and the castor wheel assembly downward as indicated by arrow 131, as the wheel mounting brackets and sleeve 121 pivot about brace 110. Pivot 125 moves inward as indicated by arrow 132 until it reaches stop 127. In this position, tab 123 and link 124 are in a slightly over center position so that the wheel is locked in its down position.

To retract the wheel, an upward force is applied to the actuating lever 114, either by hand or by foot, bring pivot 125 back through the center position and the wheel immediately retracts. The operational advantages of having the wheels retract and extend independently of the folding of the stage has previously been discussed.

Figure 7:
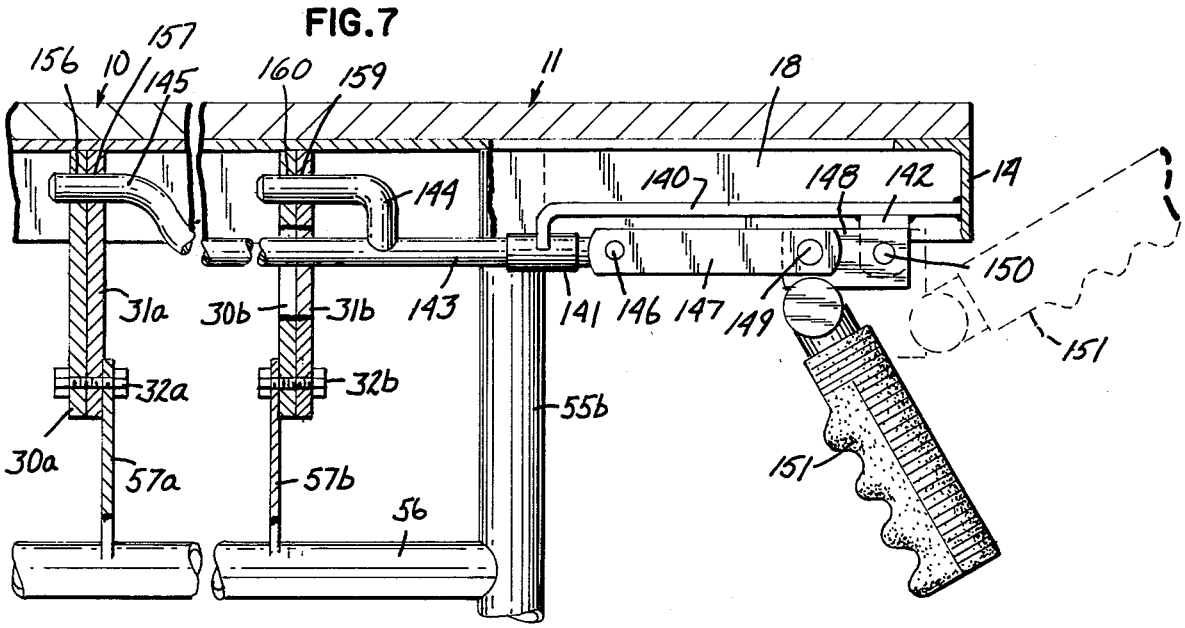
FIG. 7 is a fragmentary detail in elevation of the center leg and locking mechanism of FIG. 6.

Means are provided for locking the stage in its down, or operable position. The locking means is most clearly seen in FIGs. 6 and 7, although it is also partly visible in FIG. 4. The locking means works in conjunction with the hinge means which interconnects the two stage support members. As seen in FIG. 7, a bracket 140 is welded to reinforcing angle iron 18. Bracket 140 has a sleeve 141 attached thereto at one end, and a tab 142 near its other end. A shaft 143 is slideably mounted in sleeve 141, generally parallel to the stage surface. Shaft 143 has a prong 144 attached thereto, and the other end of shaft 143 is bent into an S-shape to form a second prong 145.

The other end of shaft 143 near sleeve 141 is pivotally attached at pivot 146 to a pair of links 147. Another pair of links 148 are pivotally connected to links 147 and pivot 149, and to bracket 140 near the edge of the stage, at pivot 150. A handle 151 is welded to links 148, and extend downwardly and outwardly at an angle thereto.

Shaft 143 slideably passes through a hole 155 provided in hinge plate 31*b.* Holes are provided in each of hinge plates 30*a, b* and 31*a,* b for accepting prongs 144 and 145 in locking relationship. Holes 156 and 157 are seen also in FIG. 3, with the stage folded. When the stage unfolds the relative pivotal motion of the hinge plates brings holes 156 and 157 into alignment with each other and with prong 145. Similarly, a hole 159 is provided in hinge plate 31*b* and a corresponding hole 160 (FIG. 7) is provided in hinge plate 30*b,* aligned with prong 144.

Once the stage is in its unfolded, or operative position, handle 151 is pushed downward and underneath the stage, causing links 148 and 147 to move shaft 143 to the left in FIGS. 7 and 6, causing the prongs to lock the hinges. To unlock the stage, handle 151 is lifted upwardly and outwardly, withdrawing the prongs from the lock holes.

When the stage is unlocked, handle 151 extends upwardly and outwardly as indicated in broken lines in FIG. 7. In this position, the handle is closely adjacent the edge of the stage. If the stage were attempted to be moved into position next to another stage, so as to form a continuous large stage surface, handle 151 would prevent moving the stage into proper position, thereby alerting the workmen to the fact that the stage has not been properly locked.

Thus, according to the present invention, we have provided an improved mobile adjustable stage which offers significant advantages in ease of operation, stability, safety, and efficiency.

We claim:

1. A mobile, elevationally adjustable foldable stage comprising:

a. a pair of generally planar stage surface members;

b. means hingeably connecting said stage surface members for movement between an operative position in which the stage surface members cojointly define a common stage surface, and a folded position;

c. main support legs associated with each of said stage surface member;

d. means pivotally mounting said main support legs to said stage surface members for allowing movement of said stage surface members to their folded position;

e. cross connect link means pivotally connected to said main support legs and to the underside of the opposite stage surface member for holding said legs approximately vertical in both the operation and folded positions;

f. elevationally adjustable lower support legs telescopically positioned within said main support legs;

g. wheel means associated with said lower support legs;

h. means for connecting said wheel means to said lower support legs for alternate extension to a floor engaging position wherein said wheel means extend further than said lower support legs, and retraction to a position short of the length of said lower support legs, thereby transferring the weight of said stage to said support legs, said means for retracting and extending said wheel means being independent of the folding of the stage;

i. a plurality of stabilizing braces having means pivotally connecting first ends thereof to said lower support legs and having means for slideably connecting the other ends thereof to said cross connect link means; and j. means for locking said slideably connected ends of said stabilizing braces to said cross connect link means according to the elevational adjustment of the stage.

2. A stage according to claim 1 wherein said wheel means comprise castor wheels mounted to said support leg by a pivotal wheel mounting bracket, and wherein said means for retraction and extension comprises a control linkage interconnecting said wheel mounting brackets and said support legs, and an actuating lever connected to said linkage for moving said linkage through an over-center position.

3. A stage according to claim 1 further including locking means connected to said hinge means, for locking said stage in its operative position.

4. A stage according to claim 3 wherein said locking means includes a lock actuator handle positioned to extend alongside at least one of said stage surface members when said locking means is unlocked, so as to prevent moving the stage into abutment with another stage when in the unlocked condition.

5. A mobile elevationally adjustable stage, comprising:

a. a pair of planar stage surface members;

b. hinge means connecting adjacent edges of said pair of stage surface members for movement between an operative position in which said stage surface members are coplanar to define a common stage surface, and a folded position in which the undersides of said stage surface members face each other;

c. main support legs for each of said stage surface members, and means pivotally connecting said support legs to the respective stage surface member at a position remote from said hinge means;

d. a plurality of cross connect links and means pivotally connecting said links to said support legs and to the underside of the opposite stage surface member;

e. elevationally adjustable lower support legs telescopically positioned within said main support legs;

f. retractable wheel means connected to said elevationally adjustable lower support legs, for alternate extension to a floor engaging position and retraction to transfer support of the stage to the support legs;

g. brace means connected to said lower support legs and to said cross connect links for stabilizing said support legs with respect to the opposite stage surface member; and h. means for adjusting the point of connection of the brace means to said lower support legs in accordance with different elevationally adjusted positions of said lower support legs.

6. A stage according to claim 5 wherein said brace means have first ends pivotally connected to said elevationally adjustable lower support legs, and have their other ends slideably connected to said cross connect links, and wherein said adjusting means includes adjustable friction lock means for securing said adjustable braces to said cross brace links at any desired position, according to the elevational adjustment of said lower support legs.

7. A stage according to claim 5 further including center support legs pivotally connected to said hinge means for supporting the center portion of said stage when in its operative position, and for remaining substantially vertical when said stage surface members are moved to their folded position, said center legs including telescopically adjustable lower portions for providing elevational adjustment.

8. A stage according to claim 5 further including a hinge lock operatively associated with said hinge means, for locking said stage in its operative position.

9. A stage according to claim 8 wherein said hinge lock means includes an actuation lever adapted for positioning adjacent an edge of said stage when its unlocked position, thereby preventing juxtaposition of a plurality of stages when in their unlocked positions.

10. An elevationally adjustable stage, comprising:

a. a pair of planar stage surface members;

b. hinge means connecting adjacent edges of said pair of stage surfaces members for movement between an operative position in which said stage surface members are coplanar to define a common stage surface, and a folded position in which the undersides of said stage surface members face each other;

c. main support legs for each of said stage surface members, and means pivotally connected said support legs to the respective stage surface member at a position remote from said hinge means;

d. elevationally adjustable lower support legs telescopically positioned within said main support legs;

e. stabilizing means connected for bracking said lower support legs with respect to the opposite stage surface member; and f. means for adjusting the effective length of said stabilizing means in accordance with the height adjustment of the stage.

11. A stage according to claim 10 wherein said stabilizing means includes cross connect links pivotally connected between said main support legs and the opposite stage surface member, and braces pivotally connected to said lower support legs and connected for stabilizing said support legs with respect to the opposite stage surface member.

12. A stage according to claim 11 wherein the said braces are slideably connected to said cross connect links and further including locking means therefor for securing said braces to said links at different positions in accordance with the height adjustment at the stage.

* * * * *

UNITED STATES PATENT AND TRADEMARK OFFICE

CERTIFICATE OF CORRECTION

PATENT NO. : 4,054,096

DATED : October 18, 1977

INVENTOR(S) : Kermit H. Wilson et al.

It is certified that error appears in the above-identified patent and that said Letters Patent are hereby corrected as shown below:

Column 2, line 56, the word "in" should be --into--.

Column 4, line 19, the word "of" should be --by--.

Column 5, line 39, the word "jand" should be --and--.

Column 5, line 61, the word "stage" should be --stage.--.

Column 6, line 58, the word "ouer" should be --outer--.

Column 7, line 41, the word "legs" should be --legs,--.

Column 8, line 36, the word "FIGs." should be --FIGS.--.

Column 11, (line 4 of double spaced text) the word "connected" should be --connecting--.

UNITED STATES PATENT AND TRADEMARK OFFICE

CERTIFICATE OF CORRECTION

PATENT NO. : 4,054,096

DATED : October 18, 1977

INVENTOR(S) : Kermit H. Wilson et al.

It is certified that error appears in the above-identified patent and that said Letters Patent are hereby corrected as shown below:

Column 11, (line 9 of double spaced text)

the word "bracking" should be --bracing--.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*